US007413413B2

(12) United States Patent
Schnetzka et al.

(10) Patent No.: US 7,413,413 B2
(45) Date of Patent: Aug. 19, 2008

(54) SYSTEM AND METHOD TO REDUCE ACOUSTIC NOISE IN SCREW COMPRESSORS

(75) Inventors: Harold Robert Schnetzka, York, PA (US); E. Curtis Eichelberger, Jr., Harrisburg, PA (US); Paul Nemit, Jr., Roanoke, VA (US)

(73) Assignee: York International Corporation, York, PA (US)

( * ) Notice: Subject to any disclaimer, the term of this patent is extended or adjusted under 35 U.S.C. 154(b) by 291 days.

(21) Appl. No.: 10/895,204

(22) Filed: Jul. 20, 2004

(65) Prior Publication Data

US 2006/0018764 A1 Jan. 26, 2006

(51) Int. Cl.
*F04B 17/00* (2006.01)

(52) U.S. Cl. ..... 417/53; 417/410.1

(58) Field of Classification Search ..... 417/53, 417/410.1, 410.4

See application file for complete search history.

(56) References Cited

U.S. PATENT DOCUMENTS 4,636,711 A * 1/1987 Freymuth ..... 318/139
4,667,279 A 5/1987 Maier
4,825,132 A 4/1989 Gritter
4,989,414 A 2/1991 Murayama
5,442,535 A 8/1995 Bourgeios
5,625,542 A 4/1997 Stemmler et al.
5,640,315 A 6/1997 Hirano et al.
5,774,842 A 6/1998 Nishio et al.
6,043,996 A 3/2000 Kumar
6,107,776 A 8/2000 Nakazawa
6,492,788 B1 12/2002 Agirman et al.
7,052,230 B2 * 5/2006 Beaven et al. ..... 417/360
7,128,539 B2 * 10/2006 Anderson et al. ..... 417/53

FOREIGN PATENT DOCUMENTS

EP 834984 4/1998

(Continued)

OTHER PUBLICATIONS

Michael M. Bech, *Analysis of Random Pulse-Width Modulation Techniques for Power Electronic Converters*, Aalborg University, Denmark Institute of Energy Technology, Aug. 2000.

(Continued)

*Primary Examiner*—Michael Koczo, Jr.
(74) *Attorney, Agent, or Firm*—McNees Wallace & Nurick, LLC

(57) ABSTRACT

A system is provided for attenuating tonal acoustic noise associated with a single positive displacement compressor, or multiple positive displacement compressors proximately located from each other. A controller selectably controls the rotational speed and the frequency of operation of each of the compressors. The controller controls the rotational speed of the compressors about a predetermined rotational speed, in a random manner, within the pre-selected speed band to reduce the magnitude of the central tonal acoustic frequency of the pressure pulsations and disperse the sound power over a wider acoustic bandwidth.

24 Claims, 2 Drawing Sheets

FOREIGN PATENT DOCUMENTS

| | | | |
|---|---|---|---|
| EP | 1 199 791 | A2 | 4/2002 |
| EP | 1 235 335 | A2 | 8/2002 |
| JP | 6014557 | | 1/1994 |
| JP | 6046489 | | 2/1994 |
| JP | 6169574 | | 6/1994 |
| JP | 10051316 | | 2/1998 |
| JP | 2000324851 | | 11/2000 |
| JP | 2001007700 | | 1/2001 |
| JP | 2002315317 | | 10/2002 |
| JP | 2002315345 | | 10/2002 |
| KR | 2001073638 | | 8/2001 |
| WO | WO 97/45950 | | 12/1997 |

OTHER PUBLICATIONS

Andrew Wang and Seth R. Sanders, *Random and Programmed Pulse-Width Modulation Techniques for DC-DC Converters*, Department of Electrical Engineering and Computer Sciences University of California, Berkeley, pp. 589-592.

Bin Huo and Andrzej M. Trzyandlowski, *Random Pulse Width PWM Modulator for Inverter-fed Induction Motor Based on the TMS320F240 DSP Controller*, University of Nevada, Electrical Engineering Dept., Reno, NV 89557, USA; email chin@ee.unr.edu.

Dallas Semiconductor Maxim, *DS1086 Spread-Spectrum EconOscillator*, 2002 Maixm Integrated Products.

* cited by examiner

SYSTEM AND METHOD TO REDUCE ACOUSTIC NOISE IN SCREW COMPRESSORS

BACKGROUND OF THE INVENTION

The present invention relates generally to a method of operation and apparatus for noise attenuation of positive displacement compressors, and more particularly, to a method of operation and apparatus for noise attenuation of screw compressors that decreases the audible noise generated by one or more of the screw compressors by varying the operating speed of each screw compressor about its respective central frequency.

Heating and cooling systems typically maintain temperature control in a structure by circulating a fluid within coiled tubes such that passing another fluid over the tubes effects a transfer of thermal energy between the two fluids. A primary component in such a system is a positive displacement compressor, which receives a cool, low pressure gas and by virtue of a compression device, exhausts a hot, high pressure gas. One type of positive displacement compressor is a screw compressor, which generally includes two cylindrical rotors mounted on separate shafts inside a hollow, double-barreled casing. The side-walls of the compressor casing typically form two parallel, overlapping cylinders which house the rotors side-by-side, with their shafts parallel to one another. Screw compressor rotors typically have helically extending lobes and grooves on their outer surfaces forming a large thread on the circumference of the rotor. During operation, the threads of the rotors mesh together, with the lobes on one rotor meshing with the corresponding grooves on the other rotor to form a series of gaps between the rotors. These gaps form a continuous compression chamber that communicates with the compressor inlet opening, or "port," at one end of the casing and continuously reduces in volume as the rotors turn and compress the gas toward a discharge port at the opposite end of the casing.

These rotors rotate at high rates of speed, and multiple sets of rotors, or multiple compressors, may be configured to work together to further increase the amount of gas that can be circulated in the system, thereby increasing the operating capacity of a system. While the rotors provide a continuous pumping action, each set of rotors produces pressure pulses as the pressurized fluid is discharged at the discharge port. These pressure pulses are generated by the compressor at increments of the operating speed of the driven screw, which is typically about 5 or 6 times the driven or operating RPM. These discharge pressure pulsations act as significant sources of audible sound within the system.

To eliminate or minimize the undesirable sound, noise attenuation devices or systems can be used. One example of a noise attenuation system is a dissipative or absorptive muffler system typically located at the discharge of the compressors. The use of muffler systems to attenuate sound can be expensive, depending upon the frequencies that must be attenuated by the muffler system. Typically, the lower the frequency of the sound to be attenuated, the greater the cost and size of the muffler system.

What is needed is an effective, low cost, efficient and easily implemented method or apparatus for compressor rotor noise attenuation.

SUMMARY OF THE INVENTION

One embodiment of the present invention relates to a method for attenuating noise in at least one positive displacement compressor. The steps include providing at least one compressor, the at least one compressor having a selectably controllable rotational speed; and varying the rotational speed of the at least one compressor in a random manner about a predetermined rotational speed to reduce the magnitude of the tonal acoustic noise associated with the at least one compressor.

The present invention further relates to a system for attenuating noise in at least one positive displacement compressor, the system includes at least one compressor, the at least one compressor having a selectably controllable rotational speed. A control panel comprises a microprocessor and a memory device, the control panel being configured to vary a rotational speed of the at least one compressor in a random manner about a predetermined rotational speed to reduce the magnitude of the tonal acoustic noise associated with the at least one compressor.

The present invention yet further relates to a chiller system including at least one refrigerant circuit. The at least one refrigerant circuit comprises at least one compressor each driven by a motor, a condenser arrangement and an evaporator arrangement connected in a closed refrigerant loop, the at least one compressor having a selectably controllable rotational speed. A control panel comprises a microprocessor and a memory device, the control panel being configured to vary a rotational speed of each motor of the at least one compressor in a random manner about a predetermined rotational speed to reduce the magnitude of the tonal acoustic noise associated with the at least one compressor.

An advantage of the present invention is the reduction in tonal acoustic noise associated with compressors driven by variable speed drives.

A further advantage of the present invention is that it can be used in single compressor systems as well as multiple compressor systems.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
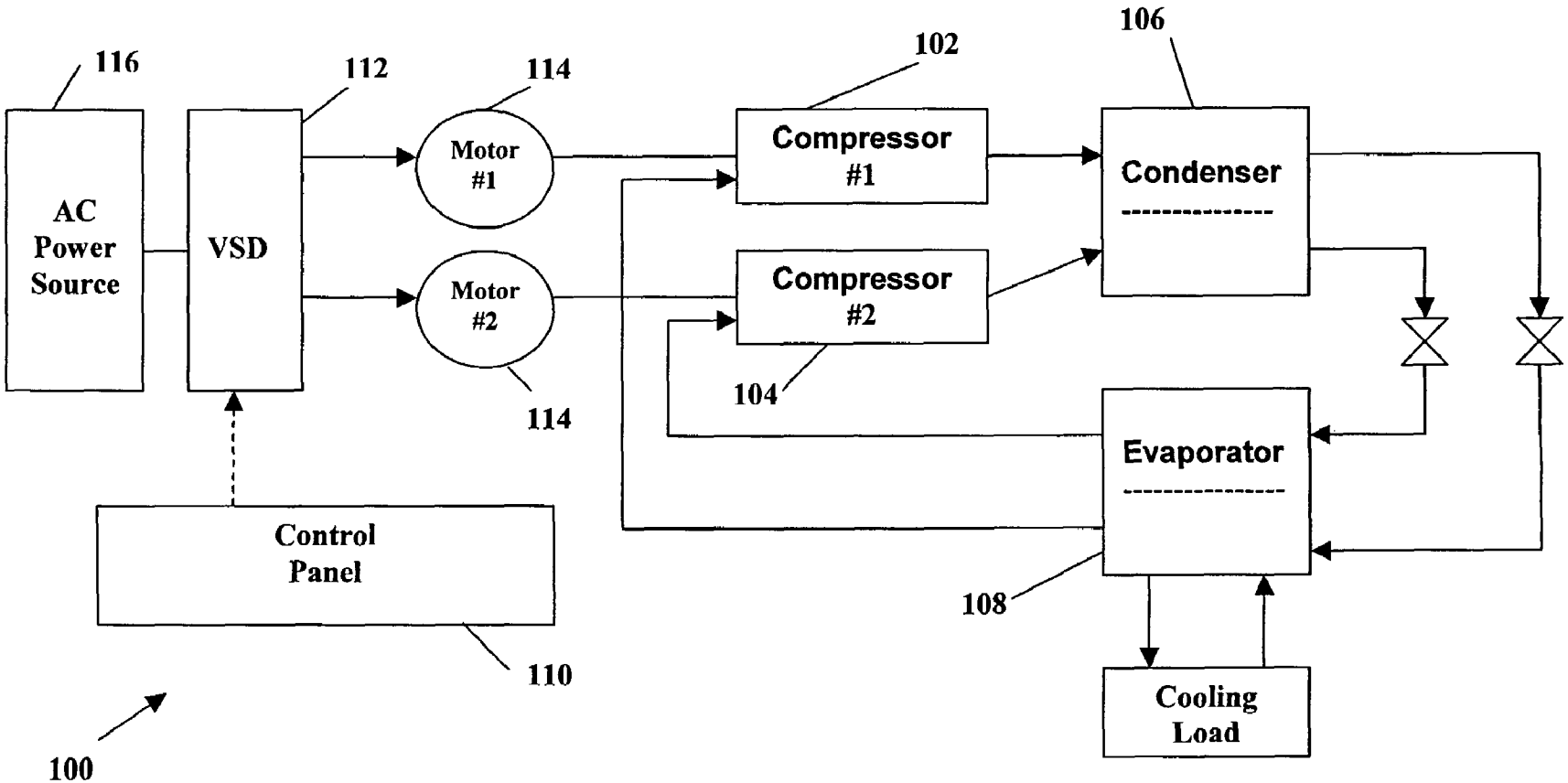
FIG. 1 illustrates schematically an embodiment of a refrigeration or chiller system used with the present invention.

FIG. 1 illustrates generally one embodiment of a refrigeration system that can incorporate the present invention. As shown in FIG. 1, the HVAC, refrigeration or liquid chiller system 100 has two compressors incorporated in corresponding refrigerant circuits, but it is to be understood that the system 100 can have one refrigerant circuit or more than two refrigerant circuits for providing the desired system load and can have more than one compressor for a corresponding refrigerant circuit. The system 100 includes a first compressor 102, a second compressor 104, a condenser arrangement 106, expansion devices, a water chiller or evaporator arrangement 108 and a control panel 110. The control panel 110 can include an analog to digital (A/D) converter, a microprocessor, a non-volatile memory, and an interface board to control operation of the refrigeration system 100. The control panel 110 can be used to control the operation of a VSD 112, which receives its electrical power from an AC power source 116, the motors 114 and the compressors 102 and 104. A conventional HVAC, refrigeration or liquid chiller system 100 includes many other features that are not shown in FIG. 1. These features have been purposely omitted to simplify the drawing for ease of illustration.

The compressors 102 and 104 compress a refrigerant vapor and deliver it to the condenser 106. The compressors 102 and 104 are preferably connected in separate refrigeration circuits, i.e., the refrigerant output by the compressors 102 and 104 are not mixed and travel in separate circuits through the system 100 before reentering the compressors 102 and 104 to begin another cycle. The separate refrigeration circuits preferably use a single condenser housing 106 and a single evaporator housing 108 for the corresponding heat exchanges. The condenser housing 106 and evaporator housing 108 maintain the separate refrigerant circuits either through a partition or other dividing means with the corresponding housing or with separate coil arrangements. In another embodiment of the present invention, the refrigerant output by the compressors 102 and 104 can be combined into a single refrigerant circuit to travel through the system 100 before being separated to reenter the compressors 102 and 104.

The compressors 102 and 104 are preferably screw compressors, although other positive displacement compressors such as reciprocating compressors, scroll compressors, rotary compressors or other type of compressor may also benefit from the motor control apparatus of the present invention. The output capacity of the compressors 102 and 104 can be based on the operating speed of the compressors 102 and 104, which operating speed is dependent on the output speed of the motors 114 driven by the VSD 112. The refrigerant vapor delivered to the condenser 106 enters into a heat exchange relationship with a fluid, e.g., air or water, and undergoes a phase change to a refrigerant liquid as a result of the heat exchange relationship with the fluid. The condensed liquid refrigerant from condenser 106 flows through corresponding expansion devices to an evaporator 108.

The evaporator 108 can include connections for a supply line and a return line of a cooling load. A secondary liquid, which is preferably water, but can be any other suitable secondary liquid, e.g., ethylene, calcium chloride brine or sodium chloride brine, travels into the evaporator 108 via return line and exits the evaporator 108 via supply line. The liquid refrigerant in the evaporator 108 enters into a heat exchange relationship with the secondary liquid to chill the temperature of the secondary liquid. The refrigerant liquid in the evaporator 108 undergoes a phase change to a refrigerant vapor as a result of the heat exchange relationship with the secondary liquid. The vapor refrigerant in the evaporator 108 then returns to the compressors 102 and 104 to complete the cycle. It is to be understood that any suitable configuration of condenser 106 and evaporator 108 can be used in the system 100, provided that the appropriate phase change of the refrigerant in the condenser 106 and evaporator 108 is obtained.

The AC power source 116 provides single phase or multiphase (e.g., three phase), fixed voltage, and fixed frequency AC power to the VSD 112 from an AC power grid or distribution system that is present at a site. The AC power source 116 preferably can supply an AC voltage or line voltage of 200 V, 230 V, 380 V, 460 V, or 600 V at a line frequency of 50 Hz or 60 Hz, to the VSD 112 depending on the corresponding AC power grid.

The VSD 112 receives AC power having a particular fixed line voltage and fixed line frequency from the AC power source 116 and provides AC power to each of the motors 114 at desired voltages and desired frequencies, both of which can be varied to satisfy particular requirements. Preferably, the VSD 112 can provide AC power to each of the motors 114 that may have higher voltages and frequencies and lower voltages and frequencies than the rated voltage and frequency of each motor 114. In another embodiment, the VSD 112 may again provide higher and lower frequencies but only the same or lower voltages than the rated voltage and frequency of each motor 114.

The motors 114 are preferably induction motors that are capable of being operated at variable speeds. The induction motors can have any suitable pole arrangement including two poles, four poles or six poles. However, any suitable motor that can be operated at variable speeds can be used with the present invention.

Figure 2:
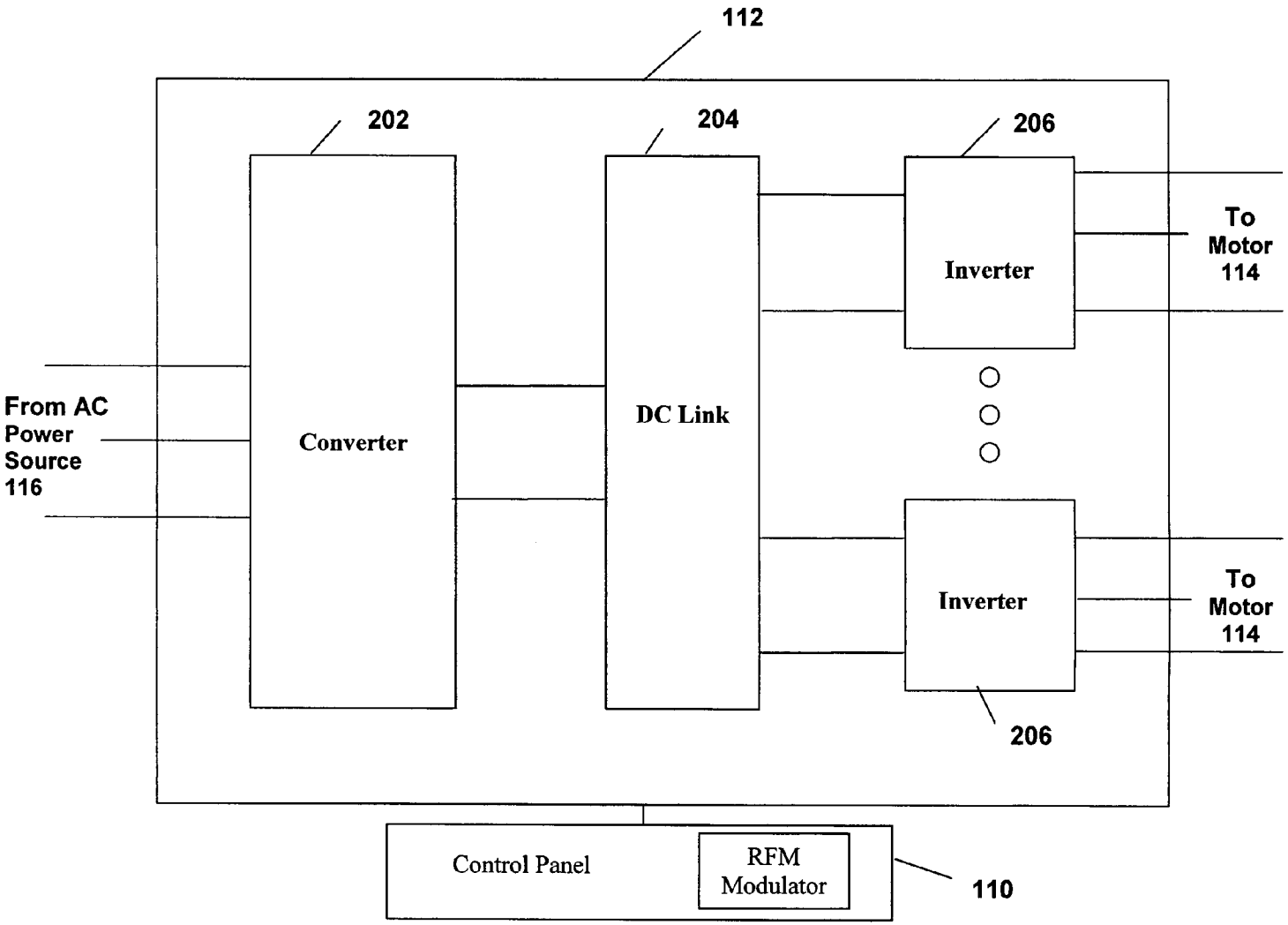
FIG. 2 illustrates schematically a variable speed drive used with the present invention.

FIG. 2 illustrates schematically some of the components in one embodiment of the VSD 112. The VSD 112 can have three stages: a converter or rectifier stage 202, a DC link stage 204 and an output stage having a plurality of inverters 206. The converter 202 converts the fixed line frequency, fixed line voltage AC power from the AC power source 116 into DC power. The converter 202 can be in a rectifier arrangement composed of electronic switches that can only be turned on either by gating, when using silicon controlled rectifiers, or by being forward biased, when using diodes. Alternatively, the converter 202 can be in an active converter arrangement composed of electronic switches that can be gated or switched both on and off, to generate a controlled DC voltage and to shape the input current signal to appear sinusoidal, if so desired. The active converter arrangement of converter 202 has an additional level of flexibility over the rectifier arrangement, in that the AC power not only can be rectified to DC power, but that the DC voltage level can also be controlled to a specific value. In one embodiment of the present invention, the diodes and silicon controlled rectifiers (SCRs) can provide the converter 202 with a large current surge capability and a low failure rate. In another embodiment, the converter 202 can utilize a diode or thyristor rectifier coupled to a boost DC/DC converter or a pulse width modulated boost rectifier to provide a boosted DC voltage to the DC link 204 in order to obtain an output voltage from the VSD 112 greater than the input voltage of the VSD 112.

The DC link 204 filters the DC power from the converter 202 and provides energy storage components. The DC link 204 can be composed of capacitors and inductors, which are passive devices that exhibit high reliability rates, i.e., very low failure rates. Finally, the inverters 206 are connected in parallel on the DC link 204 and each inverter 206 converts the DC power from the DC link 204 into a variable frequency, variable voltage AC power for a corresponding motor 114. The inverters 206 are power modules that can include power transistors, e.g., insulated gate bipolar transistors (IGBTs), with diodes connected in anti-parallel. Furthermore, it is to be understood that the VSD 112 can incorporate different components from those discussed above and shown in FIG. 2 so long as the inverters 206 of the VSD 112 can provide the motors 114 with appropriate output voltages and frequencies.

In a preferred embodiment, each motor 114 to be powered by the VSD 112 has a corresponding inverter 206 in the output stage of the VSD 112. Preferably, the number of motors 114 that can be powered by the VSD 112 is dependent upon the number of inverters 206 that are incorporated into the VSD 112. In a preferred embodiment, there can be either 2 or 3 inverters 206 incorporated in the VSD 112 that are connected in parallel to the DC link 204 and used for powering corresponding motors 114. While it is preferred for the VSD 112 to have between 2 and 3 inverters 206, it is to be understood that in a preferred embodiment more than 3 inverters 206 can be used so long as the DC link 204 can provide and maintain the appropriate DC voltage to each of the inverters 206. In certain embodiments, it may be preferable to utilize a single suitably sized inverter stage to drive multiple motors. Alternately, for a single compressor refrigerant system, only a single inverter 206 is required.

The VSD 112 can prevent large inrush currents from reaching the motors 114 during the startup of the motors 114. In addition, the inverters 206 of the VSD 112 can provide the AC power source 116 with power having about a unity power factor. Finally, the ability of the VSD 112 to adjust both the input voltage and input frequency received by the motor 114 permits a system equipped with VSD 112 to be operated on a variety of foreign and domestic power grids without having to alter the motors 114 for different power sources.

In a preferred embodiment of the present invention, the control panel 110 generates the switching signals for the IGBT power switches in the inverter modules 206 using a random frequency modulation (RFM) technique for the modulating frequency, which is the frequency that drives the motors at the desired rotational speeds. The control panel 110 preferably has a single RFM modulator for each inverter module 206 to generate the corresponding switching signals for the IGBT power switches in the inverter module 206 when the motor 114 is rotating within a predetermined range or ranges. The RFM modulator applies a random modulating frequency dithering, i.e., a random variation or fluctuation, to the IGBT power switches to randomly vary the modulating waveform to the motor 114 to vary the rotational speed of the motor 114. By randomly dithering the rotational speed of the motor 114, the frequency of the pressure pulses generated by the meshing rotors of the screw compressors are randomly varied about the central frequency of the pressure pulsations, resulting in a reduction in the tonal peaks, an increase in the bandwidth of the acoustic noise and a significant reduction in the annoyance associated with the tonal acoustic noise of the compressor operation.

RFM modulators can include, but are not limited to, a white noise generator that is sufficiently amplified to generate the desired random excitation, a random number generator within software running in a microprocessor, or an oscillator, such as a crystal clock oscillator model Maxim DS 1086 manufactured by Dallas Semiconductor of Dallas, Tex. Preferably, the RFM source can be selectably adjusted to the central frequency of the motor 114. The central frequency refers to the desired steady state operating rotational speed of the motor 114, if the RFM modulator is not used. For example, for a fixed speed screw compressor, the central frequency can be 3,000 RPM, or 3,600 RPM, depending whether the electrical power source is 50 or 60 Hz. For variable speed screw compressor operation, the central frequency is dependant upon the operational conditions of the system, with a preferred operating range of about 1,200 to about 10,000 RPM. However, it is to be understood that the present invention is not limited to this frequency range, and may be implemented on screw compressors having operating ranges significantly outside the preferred operating range. If the desired central frequency is 3,000 RPM, and the RFM modulator is set at two percent, the RFM modulator will operate to randomly vary the rotational speed of the motor 114 from 2,940 to 3,060 RPM, or a range of two percent above and two percent below the 3,000 RPM central frequency. Thus, while the rotational speed of the motor 114 operates in a band of speeds between 2,940 RPM and 3,060 RPM, the RFM modulator, on the average, provides a motor rotational speed of 3,000 RPM. It is to be understood that the RFM modulator's operational band can be set at a significantly higher percentages of the central frequency, such as at least ten percent of the maximum rated RPM, to provide a further widening of the bandwidth of the acoustic noise and an associated further reduction in the magnitude tonal acoustic noise. For screw compressors, RFM can be employed both with standard speed screws (3,000/3,600 RPM rated maximum) and high-speed screws (6,000 to 10,000 RPM rated maximum). Moreover, it is easier to implement RFM on high-speed screws, since the motors required to drive the compressors are typically smaller and have less inertia to accelerate/decelerate. Although inductions motors are preferred, any type of motor can be used, such as permanent magnet and switched reluctance motors.

In one embodiment, the control panel 110 executes a control algorithm(s) or software to control operation of the RFM modulators. The control algorithm(s) can be computer programs or software stored in the non-volatile memory of the control panel 110 and can include a series of instructions executable by the microprocessor of the control panel 110. While it is preferred that the control algorithm be embodied in a computer program(s) and executed by the microprocessor, it is to be understood that the control algorithm may be implemented and executed using digital and/or analog hardware by those skilled in the art. If hardware is used to execute the control algorithm, the corresponding configuration of the control panel 110 can be changed to incorporate the necessary components and to remove any components that may no longer be required.

Use of RFM modulators to reduce the magnitude of the tonal noise associated with compressor operation offers advantages over other types of noise reduction in that many other types of noise reduction require the use of two compressors operating in tandem. RFM allows for a decrease in audible noise for single screw compressor chillers as well as chillers that might utilize multiple compressors. Typically these multiple compressor systems require that the system operate only one compressor, for the purpose of capacity reduction, or for the retention of cooling capability when one compressor is unable to operate, such as by a failure in a refrigerant system. In these situations the use of two compressors to reduce/eliminate audible noise is no longer an option, as failure of one of the two compressors eliminates the means for a reduction in the system's audible noise level. Furthermore, in multiple compressor systems, RFM modulators may be selectably configured for each compressor so that compressor synchronization is not necessary. Stated another way, each compressor can be operated independently of the others, including having a different RFM modulator operating band frequency percentage for each compressor central frequency, if desired. Additionally, any of the RFM modulators can be deactivated if desired.

It is appreciated by those having ordinary skill in the art that the present invention is not restricted to HVAC&R application, and can be applied to any application that might require the use of a positive displacement compressor, such as an air compressor.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for attenuating noise in at least one positive displacement compressor, the method comprising the steps of:

providing at least one compressor, the at least one compressor having a selectably controllable rotational speed;

varying the rotational speed of the at least one compressor in a random manner about a predetermined rotational speed to reduce the magnitude of the tonal acoustic noise associated with the at least one compressor; and averaging the varied rotational speed to provide an average motor rotational speed equal to the predetermined rotational speed.

2. The method of claim 1 wherein the at least one compressor is a screw compressor.

3. The method of claim 1 wherein the step of varying the rotational speed includes randomly varying the rotational speed within a predetermined range about the predetermined rotational speed.

4. The method of claim 3 wherein the predetermined range is between a first predetermined percentage of the predetermined rotational speed and a second predetermined percentage of the predetermined rotational speed.

5. The method of claim 4 wherein the first predetermined percentage is ninety percent of the predetermined rotational speed and the second predetermined percentage is one hundred ten percent of the predetermined rotational speed.

6. The method of claim 4 wherein the first predetermined percentage is ninety eight percent of the predetermined rotational speed and the second predetermined percentage is one hundred two percent of the predetermined rotational speed.

7. The method of claim 4 wherein the predetermined rotational speed is a variable rotational speed.

8. The method of claim 1 wherein the step of varying the rotational speed includes varying the rotational speed with a modulator to apply a randomly varying modulating waveform to at least one motor, each motor of the at least one motor for driving a compressor of the at least one compressor, the modulator selected from the group consisting of a white noise generator, a random number generator, and an oscillator.

9. A system for attenuating noise in at least one positive displacement compressor, the system comprising:

at least one compressor, the at least one compressor having a selectably controllable rotational speed; and a control panel comprising a microprocessor and a memory device, the control panel being configured to vary a rotational speed of the at least one compressor in a random manner about a predetermined rotational speed to reduce the magnitude of the tonal acoustic noise associated with the at least one compressor; the average of the varied rotational speed being equal to the predetermined rotational speed.

10. The system of claim 9 wherein the control panel comprises a modulator to generate pulse width modulation.

11. The system of claim 9 wherein the at least one compressor is a screw compressor.

12. The system of claim 9 wherein the at least one compressor is rotatably driven by at least one electric motor.

13. The system of claim 12 wherein the at least one electric motor is selected from the group of motors consisting of a permanent magnet motor, an induction motor and a switched reluctance motor.

14. The system of claim 9 wherein the control panel comprises a device selected from the group consisting of a white noise generator, a random number generator, and an oscillator.

15. The system of claim 9 wherein the predetermined rotational speed is an operating rotational speed 0f a motor used to drive the at least one compressor.

16. The system of claim 9 wherein the predetermined rotational speed is a variable rotational speed.

17. A chiller system comprising:

at least one refrigerant circuit, the at least one refrigerant circuit comprising at least one compressor each driven by a motor, a condenser arrangement and an evaporator arrangement connected in a closed refrigerant loop, the at least one compressor having a selectably controllable rotational speed; and a control panel comprising a microprocessor and a memory device, the control panel being configured to vary a rotational speed of each motor of the at least one compressor in a random manner about a predetermined rotational speed to reduce the magnitude of the tonal acoustic noise associated with the at least one compressor.

18. The chiller system of claim 17 wherein the predetermined rotational speed is varied within a predetermined range about the predetermined rotational speed.

19. The chiller system of claim 18 wherein the predetermined range is between a first predetermined percentage of the predetermined rotational speed and a second predetermined percentage of the predetermined rotational speed.

20. The chiller system of claim 19 wherein the first predetermined percentage is ninety percent of the predetermined rotational speed and the second predetermined percentage is one hundred ten percent of the predetermined rotational speed.

21. A method for attenuating noise in at least one positive displacement compressor, the method comprising the steps of:

providing at least one compressor, the at least one compressor having a selectably controllable rotational speed; and varying the rotational speed of the at least one compressor in a random manner within a predetermined range about a predetermined rotational speed to reduce the magnitude of the tonal acoustic noise associated with the at least one compressor;

wherein the predetermined range is between a first predetermined percentage of the predetermined rotational speed and a second predetermined percentage of the predetermined rotational speed.

22. The method of claim 21 wherein the first predetermined percentage is ninety percent of the predetermined rotational speed and the second predetermined percentage is one hundred ten percent of the predetermined rotational speed.

23. The method of claim 21 wherein the first predetermined percentage is ninety eight percent of the predetermined rotational speed and the second predetermined percentage is one hundred two percent of the predetermined rotational speed.

24. The method of claim 21 wherein the predetermined rotational speed is a variable rotational speed.

* * * * *